US008104450B2

(12) United States Patent
Gentile

(10) Patent No.: US 8,104,450 B2
(45) Date of Patent: Jan. 31, 2012

(54) BACKWARDS INJECTED ENGINE

(76) Inventor: Francis X. Gentile, Los Angeles, CA (US)

( * ) Notice: Subject to any disclaimer, the term of this patent is extended or adjusted under 35 U.S.C. 154(b) by 116 days.

(21) Appl. No.: 12/758,873

(22) Filed: Apr. 13, 2010

(65) Prior Publication Data

US 2011/0088653 A1 Apr. 21, 2011

Related U.S. Application Data

(60) Provisional application No. 61/168,625, filed on Apr. 13, 2009.

(51) Int. Cl.
*F02M 63/00* (2006.01)
*F02M 61/14* (2006.01)

(52) U.S. Cl. ..... 123/298; 123/65 PE; 123/65 EM; 123/468

(58) Field of Classification Search ..... 123/65 PE, 123/65 EM, 298, 468–470, 472
See application file for complete search history.

(56) References Cited

U.S. PATENT DOCUMENTS

| | | | |
|---|---|---|---|
| 1,812,289 | A | 6/1931 | Friedl |
| 1,873,119 | A | 8/1932 | Griswold |
| 2,656,826 | A | 10/1953 | Galuska |
| 4,073,474 | A | 2/1978 | Hashimoto et al. |
| 5,197,428 | A | 3/1993 | Hornby |
| 5,205,246 | A | 4/1993 | McWhorter |
| 5,645,029 | A | 7/1997 | Ohsuga |
| 5,957,106 | A | 9/1999 | Maloney et al. |
| 6,336,320 | B1 | 1/2002 | Tanaka et al. |
| 2002/0046728 | A1 | 4/2002 | Tanaka et al. |
| 2002/0134364 | A1 | 9/2002 | Miura |
| 2005/0045145 | A1 | 3/2005 | Hiraya |
| 2007/0144470 | A1 | 6/2007 | Murase et al. |
| 2008/0060619 | A1 | 3/2008 | Allston |
| 2011/0247584 | A1 | 10/2011 | Gentile |

FOREIGN PATENT DOCUMENTS

| | | |
|---|---|---|
| WO | PCT/US10/30957 | 10/2010 |
| WO | PCT/US10/52422 | 10/2010 |

*Primary Examiner* — Erick Solis

(57) ABSTRACT

Fuel is injected into and through the exhaust port and into the cylinder of the piston engine during the time when the flow is reversed from the normally expected flow. The engine is able to operate with some or all of its fuel injected backwards of conventional expectations. In another embodiment the fuel is injected with solid stream injector sprays directed against exhaust valves and ports and deflected into the piston cylinder against the flow of normally aspirated or supercharged engines. This invention can apply to gasoline or diesel cycles and four and two stroke type cycles of engine.

26 Claims, 5 Drawing Sheets

BACKWARDS INJECTED ENGINE

BRIEF DESCRIPTION OF THE SEVERAL VIEW OF THE DRAWINGS

Drawings—Figures

Figure 1:
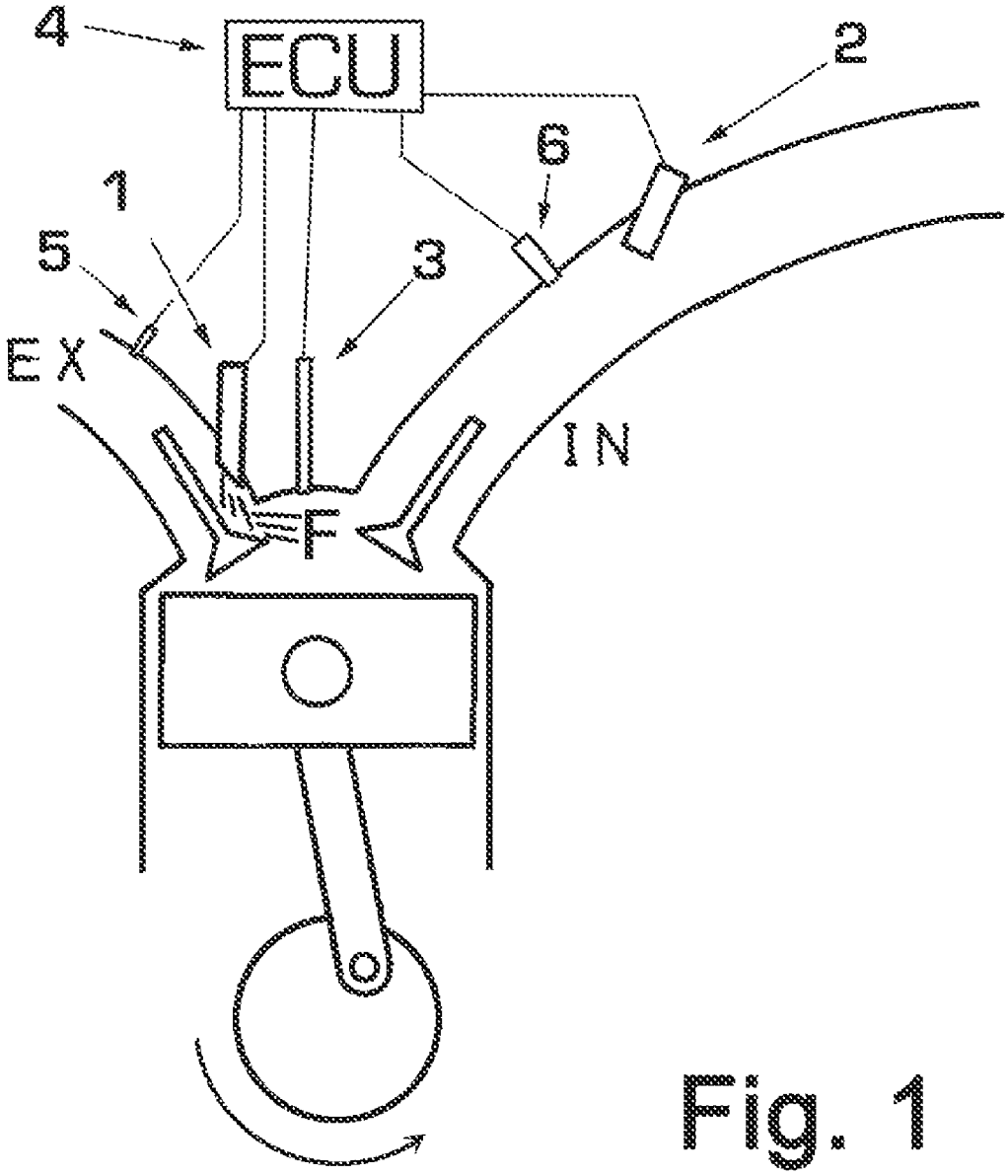
FIG. 1 Shows a System Schematic.
Figure 2:
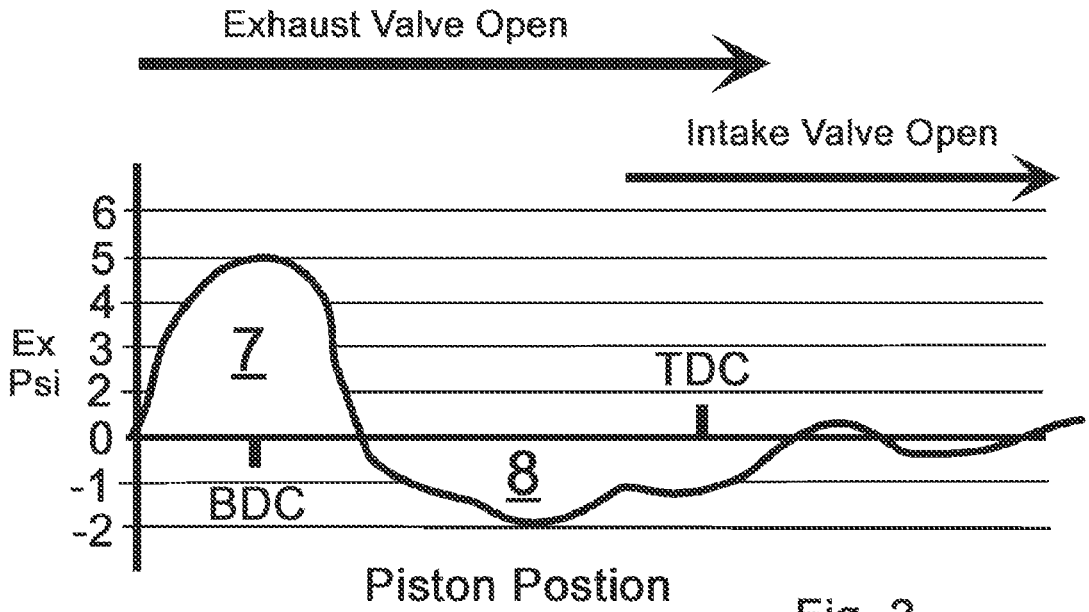
FIG. 2 Shows An example exhaust tract pressure map for a four stroke poppet valve engine is shown as an example in graph FIG. 2.

In one embodiment a piston in an internal combustion engine is pushed down to the bottom of the cylinder which causes the opening of exhaust ports. The pressure in the exhaust piping is positive 7 (FIG. 2) after combustion. The pressure is released in a wave out the exhaust system. After the positive pressure wave comes a negative pressure wave 8 (FIG. 2) which is the indication of flow known to be capable of bringing exhaust gases back thru the combustion chamber and as far as the intake tract (IN) (FIG. 1). An example exhaust tract pressure map for a four stroke poppet valve engine is shown as an example in graph FIG. 2. In practice the shape of the graph may be difficult to predict and depends on the engine configuration and operating conditions. The waves of energy are sometimes described as caused by the subsonic organ pipe effect of the end of the pipe causing the reflection backwards to its origin based on the length of the pipe. The reflections have also been described by the supersonic shock waves which can emanate from the pressure release of the opening of the exhaust valve and also reflect backwards from the end of the exhaust tube towards the origin at the exhaust valve.

Pressure in the Exhaust tract is an indirect indication of the direction of flow with in the exhaust tract, positive is flow outward from the cylinder and negative pressure into the cylinder which can be cross verified by intake pressure, crankshaft or camshaft position, cylinder pressure. In one embodiment pressure sensors in the exhaust tract 5 (FIG. 1), combustion chamber 3 (FIG. 1), intake tract 6 (FIG. 1) send condition information to the Engine Control Unit (ECU) 4 (FIG. 1). The ECU triggers fuel injectors in the exhaust port 1 (FIG. 1). The ECU can also trigger fuel injector 2 (FIG. 1) on the conventional intake side when conditions are desirable or necessary such as when the engine is cold and starting. For simplicity the other sensors commonly used on fuel injections are not shown in the diagram, but would or could be used, for example, oxygen sensor, knock sensor, air mass sensor, intake temperature, cylinder head temperature, exhaust gas temperature.

Another embodiment of this invention utilizes variations in the fuel delivered from the intake and the exhaust ports to achieve variation in fuel to air ratios that allow ignition while also allowing complete burning without high combustion temperatures which lead to nitrogen oxide formation.

Another embodiment of this invention utilizes different fuels in the intake versus the exhaust to better achieve the results described in the paragraph above.

Figure 3:
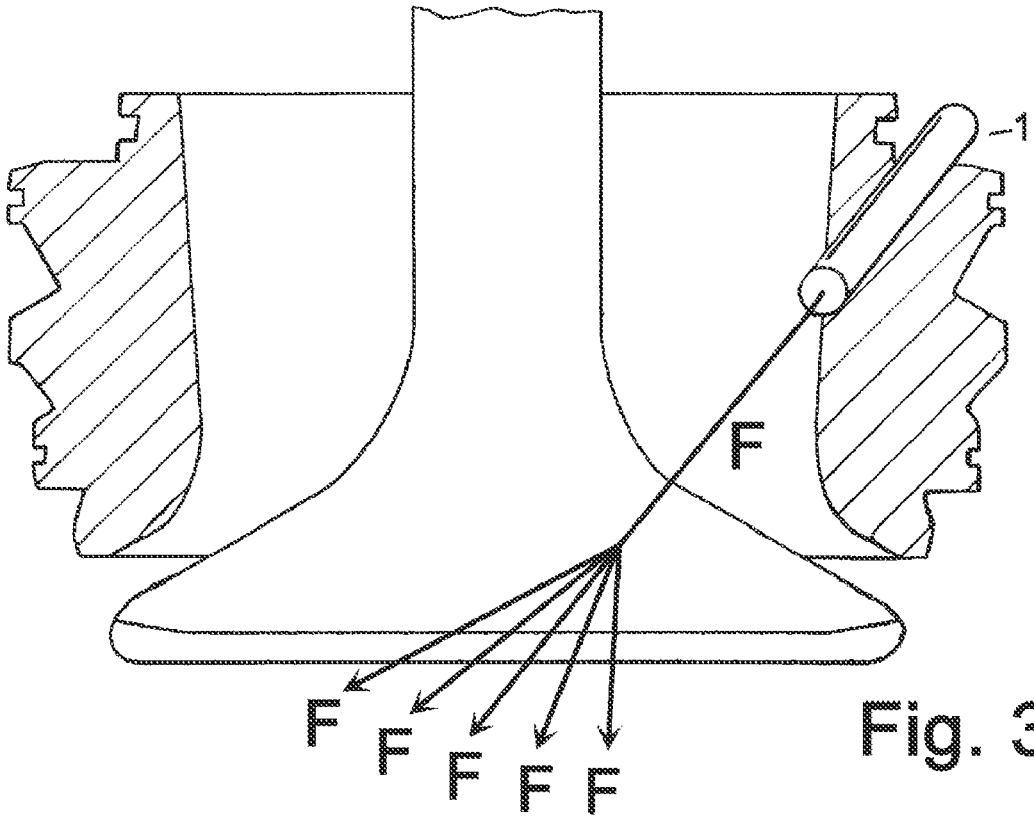
FIG. 3 Shows an embodiment of deflecting solid streams of fuel (F) (or water) onto the exhaust valves.

In FIG. 3 show An embodiment of deflecting solid streams of fuel (F) (or water) onto the exhaust valves to create atomization of fuel, entry of fuel into the combustion chamber against or with the gas flow, cooling of the valve central body.

As velocity decreases over distance more rapidly as droplets form and become smaller, a solid stream therefore maintains the maximum velocity against turbulence and opposite gas flow and therefore is able to oppose and traverse the exhaust gas flow. The impact of the solid stream on the poppet valve produces different liquid sheet angles and the break-up lengths at various angles and locations of impact on different shapes of valves.

Restated, Solid stream nozzles provide the highest impact per unit area. The large free passage design through the typically round solid stream nozzle orifice reduces clogging. In one embodiment a solid stream non-atomized spray directed against the exhaust valve achieves fuel heating and atomization from the deflection impact against the valve and the fuel charge flow against the flow of exhaust gases.

Figure 4:
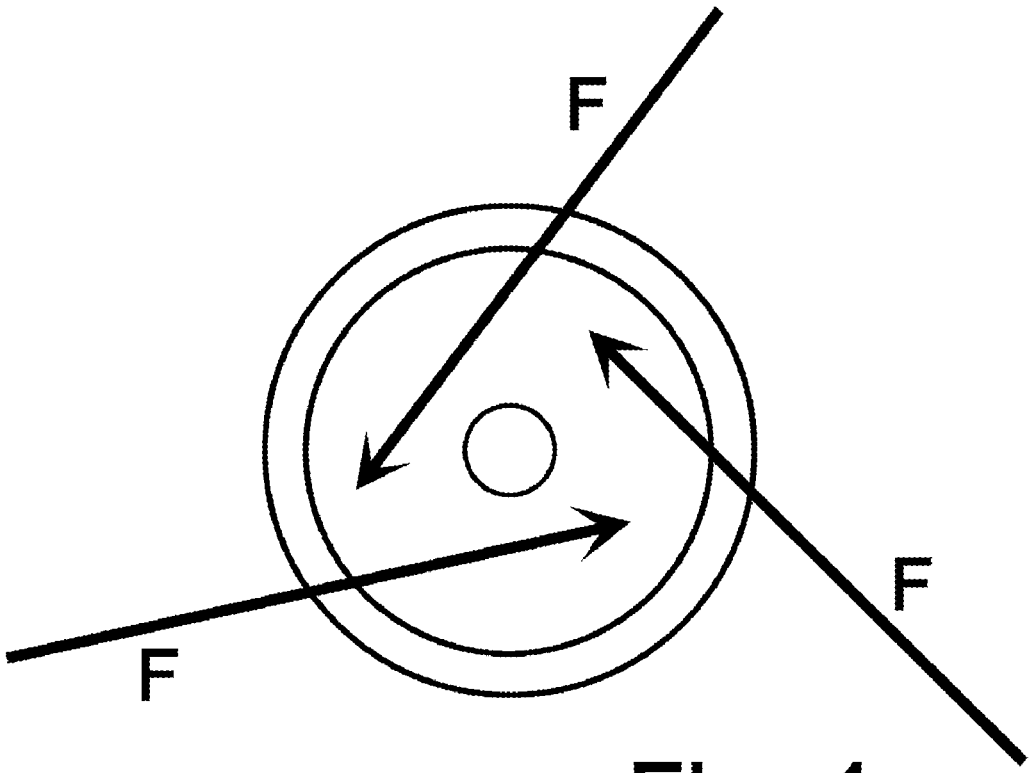
FIG. 4 Shows a view of an exhaust poppet valve from above showing an embodiment with three solid stream fuel (F) injection streams deflected off of evenly distributed points of the valve.

More than one injector can be used to create even thermal conditions in the valve metal which would reduce internal stresses within the metal because of differences in thermal expansion and contraction. FIG. 4 is a view of a exhaust poppet valve from above showing an embodiment with three solid stream fuel (F) injection streams deflected off of evenly distributed points of the valve.

The location of highest heat in the valve are presented in U.S. Pat. No. 4,073,474. Heat in the poppet valve periphery that contacts the valve seat is conducted away from the poppet valve. The hot center of the valve disk or head expands the metal against the cooler less thermally expended valve head periphery in contact with the valve seat, resulting in hoop stress and cracks within the valve periphery that contacts the valve seat within the intake tract. In one embodiment of this invention cooling from fuel and or water spray would be best directed upon this hot center of the valve head. Described in alternate language, the solid spray impacts between the beginning of the poppet valve stem and the beginning of the part of the valve periphery which makes contact with the valve seat in the cylinder head.

Fortunately the exhaust valve is typically placed in the cylinder head with a short exit path to the exhaust header, so it maybe possible to perform conversions of existing engines by installing injectors in the exhaust headers. Smaller injectors know as pico injectors are available. Smaller single cylinder engines or engines with separated cylinders allow more direct access to the exhaust valve from many directions and thus are better candidates for inexpensive conversion.

Figure 5:
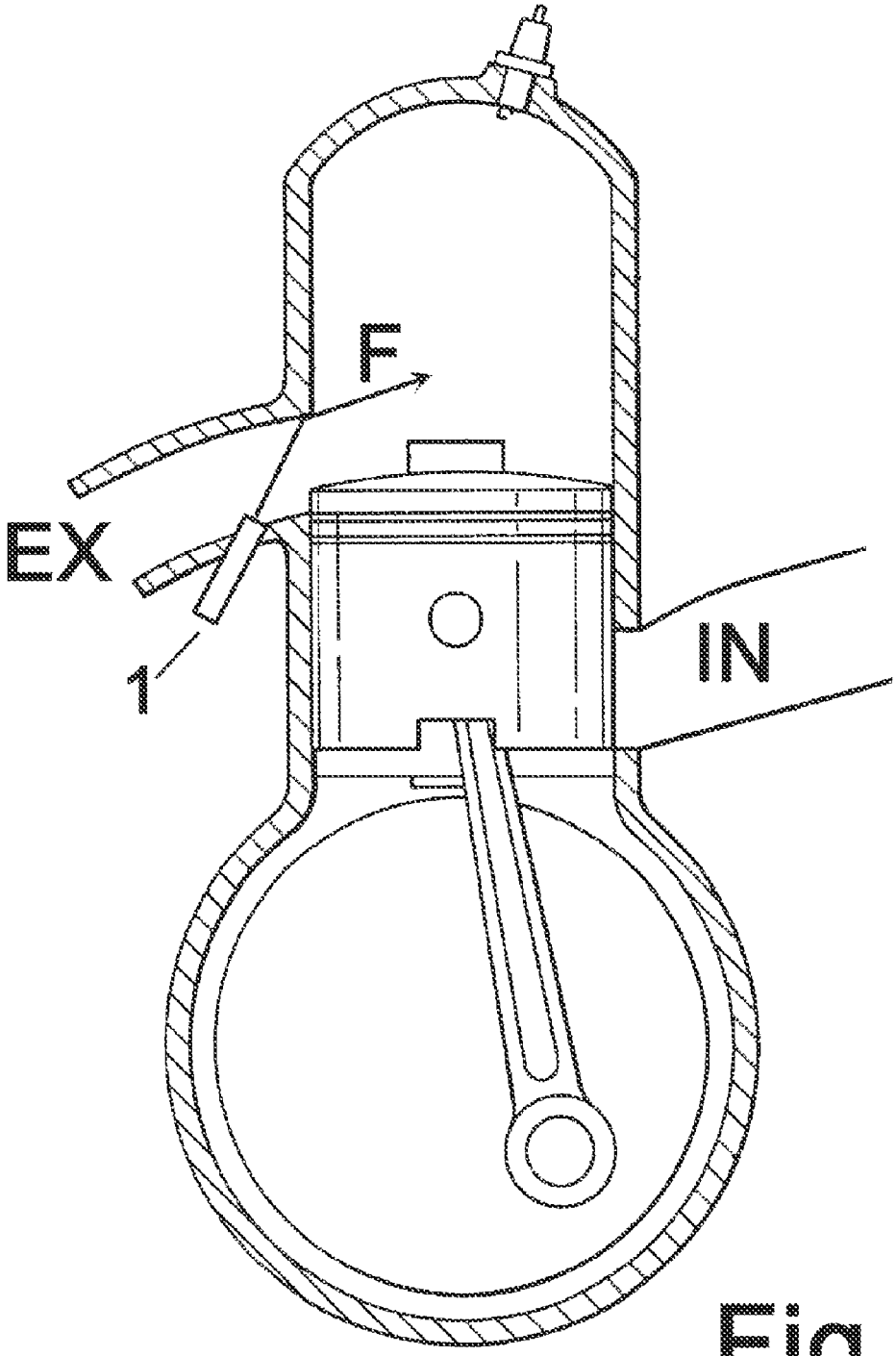
FIG. 5 illustrates an embodiment of one or more solid stream or non-atomizing fuel injector's 1 injections are deflected against the exhaust tract edge of a piston operated cylinder exhaust valve port and said stream (F) is deflected into said combustion chamber and or cylinder of a two stroke engine.

Small two stroke engines present a simpler conversion. FIG. 5 illustrates embodiment of one or more solid stream or non-atomizing fuel injector's 1 injections are deflected against the exhaust tract edge of a piston operated cylinder exhaust valve port and said stream (F) is deflected into said combustion chamber and or cylinder of a two stroke engine.

I claim:

1. A naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments when the exhaust flow is backwards while said exhaust valve is open.

2. The engine of claim 1 wherein one or more solid stream or non-atomizing fuel injector's injections are deflected against the area of an exhaust poppet valve that exists between the stem of the valve and the part of the valve which touches the valve seat when closed, and said stream is deflected into said combustion chamber and or cylinder.

3. The engine of claim 1 wherein one or more solid stream or non-atomizing fuel injector's injections are deflected against the area of an exhaust poppet valve that touches the exhaust poppet valve seat when closed, and said stream is deflected into said combustion chamber and or cylinder.

4. The engine of claim 1 wherein one or more solid stream or non-atomizing fuel injectors inject through the gap between the exhaust poppet valve and the valve seat and said stream enters undeflected into said combustion chamber and or cylinder.

5. The engine of claim 1 wherein an atomizing fuel injector injects fuel towards said exhaust valve.

6. The engine of claim 1 wherein one or more solid stream or non-atomizing fuel injector's injections are deflected against the exhaust tract edge of a piston operated cylinder exhaust valve port and said stream is deflected into said combustion chamber and or cylinder.

7. The engine of claim 1 wherein one or more solid stream or non-atomizing fuel injectors inject through an open piston operated cylinder exhaust valve port into said combustion chamber and or cylinder.

8. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open.

9. The engine of claim 8 wherein one or more solid stream or non-atomizing fuel injector's injections are deflected against the area of an exhaust poppet valve that exists between the stem of the valve and the part of the valve which touches the valve seat when closed, and said stream is deflected into said combustion chamber and or cylinder.

10. The engine of claim 8 wherein one or more solid stream or non-atomizing fuel injector's injections are deflected against the area of an exhaust poppet valve that touches the exhaust poppet valve seat when closed, and said stream is deflected into said combustion chamber and or cylinder.

11. The engine of claim 8 wherein one or more solid stream or non-atomizing fuel injectors inject through the gap between the exhaust poppet valve and the valve seat and said stream enters undeflected into said combustion chamber and or cylinder.

12. The engine of claim 8 wherein an atomizing fuel injector injects fuel towards said exhaust valve.

13. The engine of claim 8 wherein one or more solid stream or non-atomizing fuel injector's injections are deflected against the exhaust tract edge of a piston operated cylinder exhaust valve port and said stream is deflected into said combustion chamber and or cylinder.

14. The engine of claim 8 wherein one or more solid stream or non-atomizing fuel injectors inject through an open piston operated cylinder exhaust valve port into said combustion chamber and or cylinder.

15. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within the exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open with a means for simultaneously cooling said exhaust valves and heating the fuel mixture by injecting fuel through said exhaust valve into said combustion chamber of said internal combustion engine during the exhaust cycle.

16. A method in a supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within the exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open of deflecting a solid stream of fuel off of parts of the exhaust side of said exhaust valves or nearby surrounding areas to direct and atomize the fuel into said combustion chamber or said cylinder while overcoming hot gas flow in the opposite direction without burning or explosion.

17. A method in a supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within the exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, of timing the injection into the exhaust side of said exhaust valves or nearby surrounding areas by measuring the pressure around the area of said exhaust side of said exhaust valve to estimate the direction of flow to inject with the flow back into the combustion chamber or cylinder.

18. A method in a supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, of complete burning without high combustion temperatures by optimizing variation of air fuel ratios and total amounts of fuel and or types of fuel shared between intake and exhaust injections; optimizing for the difference in heating of the fuel between said intake and said exhaust injection sources and optimizing for the longer overall mixing time and residency time and hotter and different combustion gases available to the exhaust injected fuel while only said exhaust valve is open in comparison to the intake injection; controlling injectors by the ECU using the knock sensing, exhaust gas temperature, cylinder head temperature, oxygen sensor, air mass sensor, intake temperature and pressure sensors in said exhaust tract valve area, said combustion chamber and said intake.

19. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open with fuel injectors injecting from outside said intake and said exhaust valves into said combustion cylinder and controlled by the ECU and sensors of knocking sensing, exhaust gas temperature, cylinder head temperature, oxygen sensor, air mass, intake temperature and pressure in said exhaust tract valve area, said combustion chamber and said intake; as a first means for optimizing variation of air fuel ratios and total amounts of fuel and or types of fuel shared between intake and exhaust injections; including a second means for optimizing for the difference in heating of the fuel between intake and exhaust injection sources; including a third means for optimizing for the longer overall cylinder residency mixing time and the hotter and different combustion gases available to the exhaust injected fuel in comparison to the intake injection while only said exhaust valve is open; producing complete burning without high combustion temperatures.

20. A method in a supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, of timing the injection into the exhaust side of said exhaust valves or nearby surrounding areas of said engine and into said cylinder chamber by cross verifying by intake pressure, crankshaft or camshaft position, cylinder pressure for comparison of the 3 pressures and valve positions that would allow backwards flow from high to low relative pressures.

21. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, having pressure sensors in the exhaust side of said exhaust valve area and said cylinder and intake side of said intake valve area and measurements of crankshaft or camshaft position as the means for cross verifying relative pressures and valve opening positions that would allow backwards flow from high to low relative pressures producing a signal to inject fuel into said cylinder chamber from the area of said exhaust side of said exhaust valve.

22. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into the combustion chamber thru an open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, whose exhaust poppet valve and stem areas are impacted by 3 solid stream fuel injectors whose fuel injections are deflected against the area of said exhaust poppet valve that exists between the stem of said exhaust valve and the part of said exhaust valve which touches said exhaust valve seat when closed, whose fuel injections are evenly spaced around the circular shape and at a fuel angle to the impacted surface of said exhaust valve that is between perpendicular and tangent and the streams are deflected into said combustion chamber and or said cylinder.

23. A method in a supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru an open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, of creating even thermal conditions in said exhaust valve materiel which would reduce internal stresses within said materiel because of differences in thermal expansion and contraction by cooling said exhaust valve with 3 solid stream fuel injectors whose fuel is evenly spaced around the circular shape and at fuel angle to the impacted surface of said exhaust valve that is between perpendicular and tangent, and the fuel injections are deflected against the area of said exhaust poppet valve that exists between the stem of said exhaust valve and the part of said exhaust valve which touches the valve seat when closed and the streams are deflected into the combustion chamber and or said cylinder.

24. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open, having an exhaust poppet valve and stem area surrounded by 3 solid stream fuel injectors as a first means for injecting fuel at an angle to the impacted surface of said exhaust valve that is between perpendicular and tangent and evenly spaced around the circular shape and by a second means fuel injections are deflected against the area of said exhaust poppet valve that exists between the stem of said exhaust valve and the part of said exhaust valve which touches said exhaust valve seat when closed and the streams are deflected into the combustion chamber and or cylinder, producing even thermal conditions in said exhaust valve materiel which would reduce internal stresses within said exhaust materiel because of differences in thermal expansion and contraction.

25. A naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments when the exhaust flow is backwards while the exhaust valve is open and whose exhaust poppet valve and stem area is impacted by 3 solid stream fuel injectors and whose fuel injections are deflected against the area of said exhaust poppet valve that exists between the stem of said exhaust valve and the part of said exhaust valve which touches the valve seat when closed, and whose fuel injections are evenly spaced around the circular shape at a fuel angle to the impacted surface of said exhaust valve that is between perpendicular and tangent and the streams are deflected into said combustion chamber and or said cylinder.

26. A supercharged or naturally aspirated internal combustion piston engine with separate intake and exhaust valves with substantially and continuously separate exhaust and intake tracts leading separately to the atmosphere, whose exhaust tract is of a length and continuity where no substantial fresh air would flow backwards down said exhaust tract into the combustion chamber as a result of common pressure waves, wherein the fuel is forcibly injected from within said exhaust tract into said combustion chamber thru said open exhaust valve port into said combustion chamber and cylinder for the next cycle of combustion thru said exhaust valve of said combustion chamber or said cylinder from a distance from said exhaust valve equal to less than 10 diameters of the circle equivalent two dimensional sectional area of said exhaust valve tract and face opening junction, during the moments while said exhaust valve is open and whose exhaust poppet valve and stem area is impacted by 3 solid stream fuel injectors and whose fuel injections are deflected against the area of said exhaust poppet valve that exists between the stem of said exhaust valve and the part of said exhaust valve which touches the valve seat when closed, and whose fuel injections are evenly spaced around the circular shape at a fuel angle to the impacted surface of said exhaust valve that is between perpendicular and tangent and the streams are deflected into said combustion chamber and or said cylinder.

* * * * *